United States Patent [19]

Söderbaum

[11] Patent Number: 4,589,850

[45] Date of Patent: May 20, 1986

[54] BOAT PROPELLER DRIVE UNIT

[75] Inventor: Ulf Söderbaum, Skärhamn, Sweden

[73] Assignee: AB Volvo Penta, Gothenburg, Sweden

[21] Appl. No.: 651,848

[22] Filed: Sep. 18, 1984

[30] Foreign Application Priority Data

Sep. 20, 1983 [SE] Sweden ..... 8305060

[51] Int. Cl.[4] ..... B63H 5/12

[52] U.S. Cl. ..... 440/61

[58] Field of Search ..... 440/53, 56, 57, 61, 440/59

[56] References Cited

U.S. PATENT DOCUMENTS

| | | | |
|---|---|---|---|
| 3,191,573 | 6/1965 | Hixon | 440/59 |
| 3,888,203 | 6/1975 | Lohse | 440/61 |
| 4,086,869 | 5/1978 | Woodruff | 440/61 |

*Primary Examiner*—Sherman D. Basinger
*Assistant Examiner*—Jesûs D. Sotelo
*Attorney, Agent, or Firm*—Young & Thompson

[57] ABSTRACT

In an outboard drive unit for boats, the drive shaft housing is swingable by hydraulic cylinders for trimming and tilting. One end of each cylinder is pivotally journalled in the shield of the drive unit, whereas the opposite cylinder ends bear against abutment surfaces on the carrier fork shanks conventionally supporting the drive shaft housing. An intermediate member, pivotally connected to the cylinders via pivot pins, is pivotally suspended in the carrier fork, moving along with it during trimming and tilting. A pivot pin fixed into the intermediate member constitutes one part of a mechanical latch, the other part being formed of a latch hook (not shown) rotatably journalled on the carrier forks. The latch is thereby completely disengaged upon propeller thrusts during forward travel.

8 Claims, 3 Drawing Figures

BOAT PROPELLER DRIVE UNIT

Figure 1:
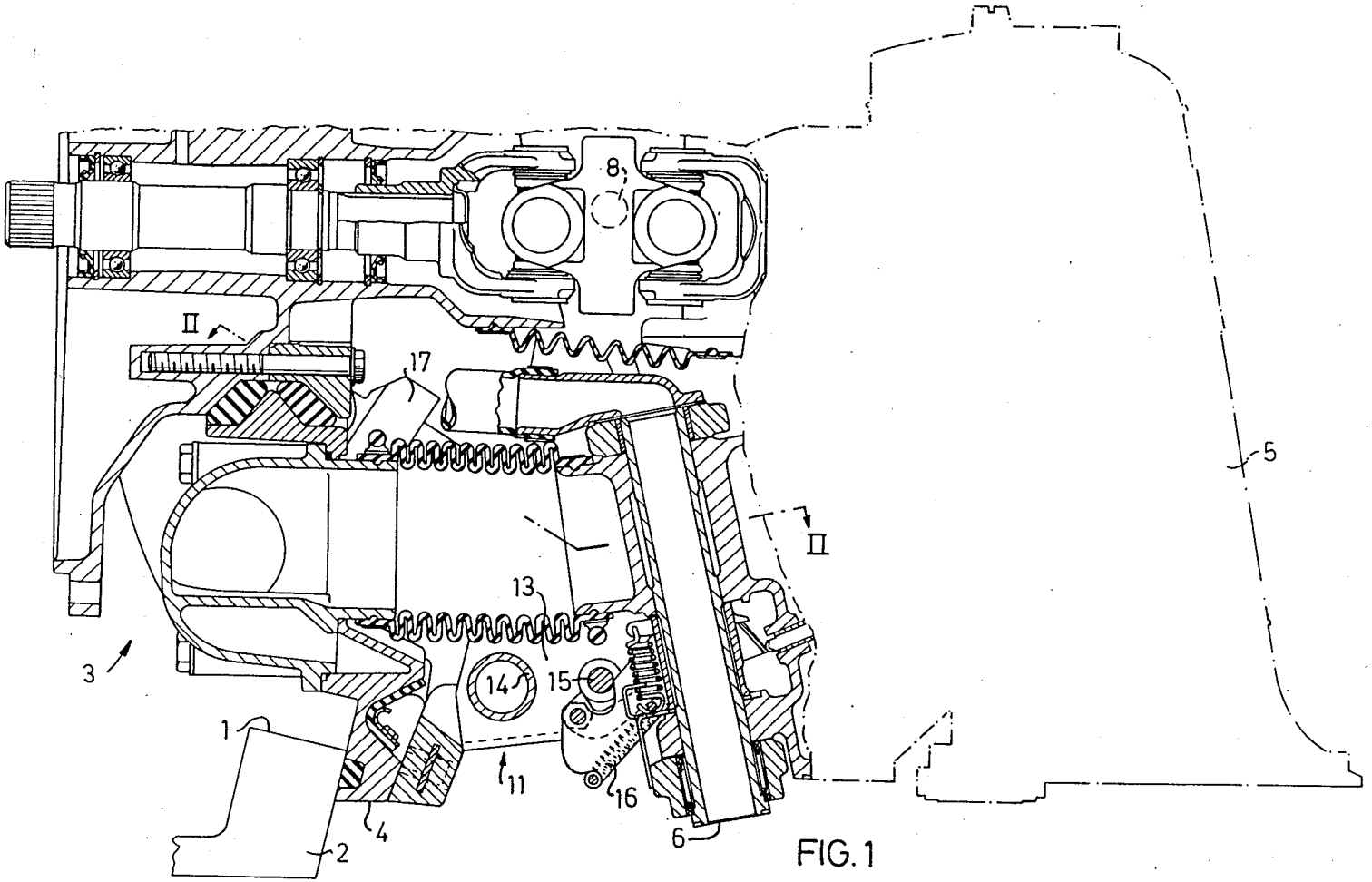

The present invention relates to a propeller drive unit comprising a portion intended to be secured in an aperture on a boat transom stern for further connection to an engine accommodated on the inside of the transom stern and to a propeller drive shaft housing disposed on the outside of the transom stern and carried by a fork-like support structure having shanks journalled in the securely mountable portion for rotation about a transverse, horizontal pivot axis under the influence of a pair of pressurized-medium actuated piston-cylinder units situated on either side of the drive shaft housing centerplane, interacting locking members being arranged for preventing in their locking position the support structure from pivoting about said pivot axis.

With constructions of this type, the drive shaft housing can be trimmed while the boat is in motion, i.e. its angle of inclination relative to the boat transom stern can be varied for adjustment to the position of travel of the boat through the water, by activating the piston-cylinder units from the driver's seat. When the boat is stationary, the piston-cylinder units are employed for tilting the drive shaft upwardly so that the propeller housing is elevated out of the water. The piston-cylinder units and their means coacting with the drive shaft suspension must thereby be designed and dimensioned in such a manner that they can take up the propeller thrusts acting on the drive shaft housing during travel, permitting at the same time the drive shaft housing to be folded up at rearwardly directed shock loads occurring for example when running aground or upon striking an object floating in the water.

To accomplish this there are known two principally different solutions according to one of which the piston-cylinder units are pivotally mounted in the fixed portion of the drive unit and in the support structure of the drive shaft housing, valve means being arranged which are urged to establish direct communication between the cylinder chambers on both sides of the piston when the drive unit is subjected to thrust loads, so that pressurized medium can rapidly flow from one cylinder chamber and into the other. According to the second solution, the compressive forces of the piston-cylinder units are transmitted to the support structure of the drive shaft housing via a mechanical latch triggering off at thrust loads enabling in this way an upward tilt of the drive shaft housing. Said latch must therefore transmit the propeller thrust forces under all driving conditions, and since these forces can reach substantial magnitudes during forward propulsion, a heavily dimensioned structure of the power transmitting components of the latch will be required.

In accordance with a known embodiment, each individual piston-cylinder unit is pivotally mounted in its respective solid metal sheet or plate, which plates are interconnected and rotatably journalled on the pivot axis of the drive shaft housing outside the bearings for the drive shaft suspension fork. A pivot pin extending between said plates consitutes one of two interacting locking members. The other locking member is formed of a rotatably journalled latch hook having abutment surfaces adapted to receive the pivot pin. Via abutment surfaces on the suspension fork, the pivot pin and the rotatably journalled plates, the propeller thrusts are transmitted to the piston-cylinder units during forward travel, which means that all these components must have extremely heavy dimensions. As a result thereof, the structure will require much space particularly in its transverse direction, and the mutual distance between the piston-cylinder units will be relatively large. In this way these units will be left without shelter with their points of attachment in the drive shaft suspension shield disposed relatively far out from the shield center.

The purpose of the invention is to achieve a boat propeller drive unit provided with a mechanical latch enabling a weaker and more compact construction of the locking means coacting with the piston-cylinder units and providing thereby a better protection for the piston-cylinder units.

This is accomplished according to the invention with a propeller drive unit of the kind mentioned in the introduction by means of which one end of each piston-cylinder unit is pivotally connected to the fixed portion of the propeller drive unit while the other end rests upon an abutment surface on the fork-like support structure, and in that one of the locking members is disposed on an intermediate member which is pivotally connected to the piston-cylinder unit and to the support structure in such a manner that the position of said locking member relative to a coacting locking member, carried by the support structure, remains unchanged upon adjustment of the support structure angle relative to the securely mounted portion.

With the inventive embodiment, the propeller thrust forces will be absorbed directly by the cylinder units at forward propulsion thereby completely releasing the locking means which then only need to take up the rearwardly directed thrusts when reversing or when throttling down at forward travel. The various components of the locking means can therefore be given weaker dimensions. In this manner the opportunity is provided for the heavily dimensioned intermediate member, journalled on the pivot axis of the carrier fork outside this fork in accordance with previously known constructions, to be replaced by a smaller intermediate member journalled directly in the carrier fork thereby making it possible to have the cylinders more closely spaced. This in turn will safeguard a sheltered placement of the attachment points of the cylinders inside a collar disposed on the shield.

Figure 2:
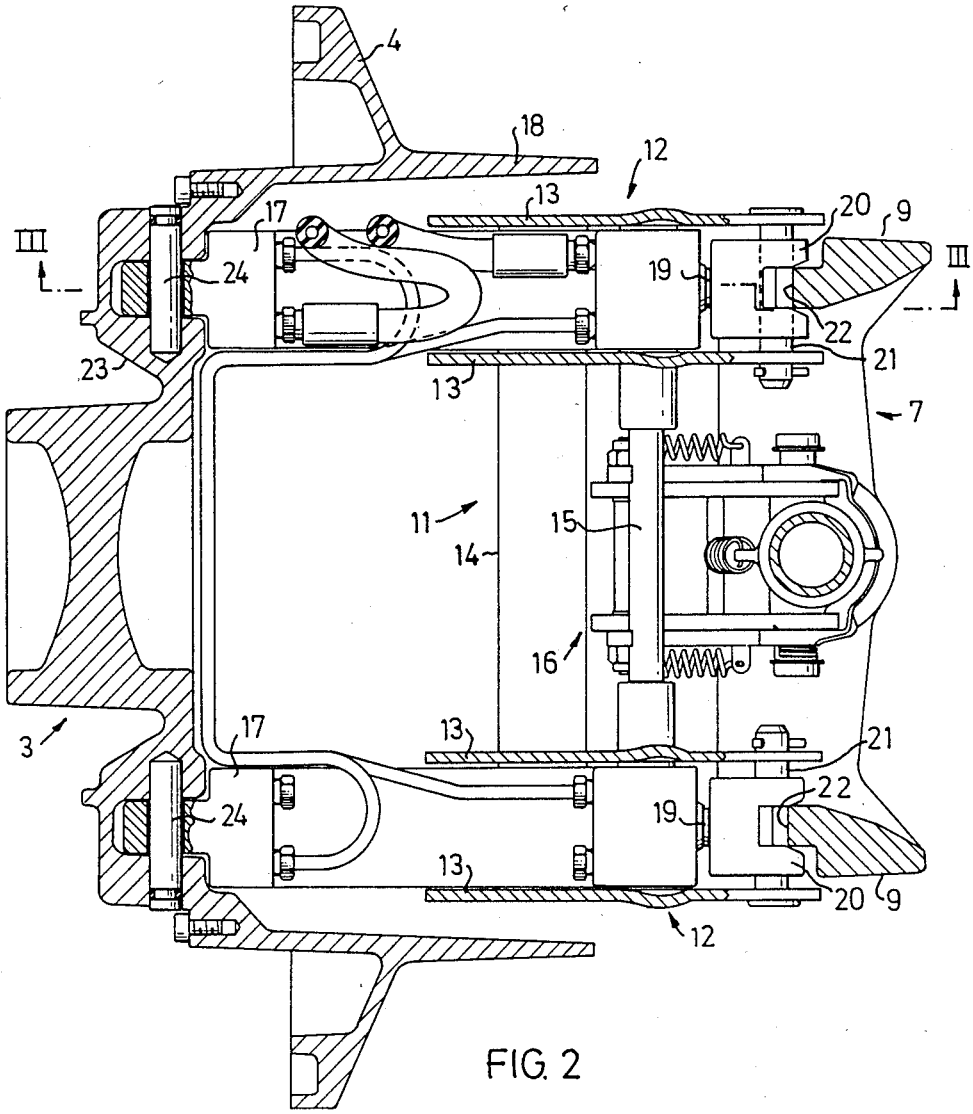
Figure 3:
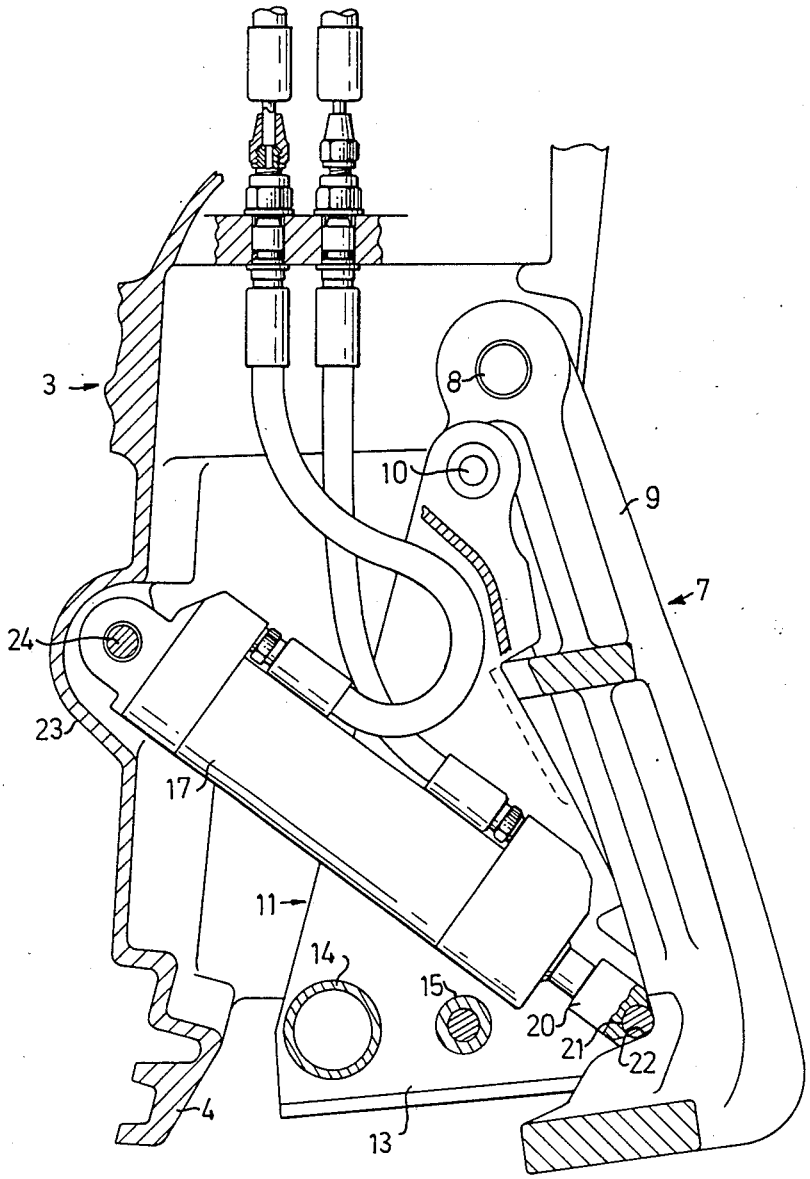

The invention will be described in more detail below while referring to an exemplary embodiment illustrated in the accompanying drawings, of which FIG. 1 is a partially sectional side view of a portion of a propeller drive unit according to the invention, FIG. 2 is a section along the line II—II in FIG. 1, and FIG. 3 is a section along the line III—III in FIG. 2.

In FIG. 1, a number of details lacking relevance to the invention have been left out or are indicated only schematically, and in the following only such components which are essential for the understanding of the invention will be described with reference to the figures.

The propeller drive unit shown has a portion generally designated by the numeral 3 which is fixed into an aperture 1 on a transom stern 2 and has a suspension plate or shield 4 sealing tightly against the edges of the aperture 1. A propeller drive shaft housing 5 is connected to a steering shaft 6 journalled in bearings on a fork-shaped support structure 7 which is in turn journalled in a known manner for rotation relative to the fixedly mounted portion 3 about a horizontal pivot shaft 8 the center of which coinciding with the center of the propeller device drive joint.

The support structure 7 has a pivot pin 10 disposed immediately below the pivot shaft 8 on the inside of each shank 9. Rotatably journalled on the pivot pins 10 is a triangular intermediate member generally designated by the numeral 11 and consisting of two identical parts 12 formed in turn of two mutually fixed plates 13, which are all united via a tube 14. Parallel with the tube 14, a pivot pin 15 is fixed into the plates 13. The pin 15 constitutes one of two coacting locking members. The other locking member is formed of a hook 16 of a kind known per se pivotally journalled on the support member 7 and gripping around the pin 15 so as to prevent the drive shaft housing from swinging upward when subjected to normal changes in the direction of thrust caused by throttling down or shifting from forward to reverse, but releasing its grip around the pin at rearwardly directed shock loads.

A pair of hydraulic cylinder units 17 are rotatably journalled in the fixed portion 3 of the propeller device. As seen in FIG. 2, the cylinders are accommodated inside a collar 18 formed integrally with the shield 4. The piston rods 19 of the cylinder are joined to end pieces 20 gripping around pivot pins 21 fixed in the rear corner of the intermediate member 11. The support structure 7 is L-shaped, forming in its angle abutment surfaces 22 for the pivot pins. As seen in FIG. 3, this embodiment allows for rearwards displacement of the engaging position in relation to an embodiment having straight support shanks and providing in this way space for hydraulic cylinders with sufficient stroke for tilting the drive shaft upwards and lifting the propeller housing up and out of the water.

When trimming during forward travel, the intermediate member 11 will thus swing along with the carrier fork 7 so that the position of the pivot pin 15 and the latch hook 16 remains unchanged in relation to one another. These components are however totally released from forwardly directed propeller thrusts but these forces will instead be transmitted from the drive shaft housing 5 to the fixed portion 3 via the hydraulic cylinders 17. As can be seen from FIG. 3 in particular, the construction is made extremely compact providing a well-protected accommodation for the cylinders 17. In the embodiment shown, the cylinders are placed so close together that they may even be allowed within the circumference of the recess in the transom stern thus making it possible, as shown in FIG. 2, to have them journalled in a bottom portion 23 projecting into the recess. In this way the cylinder pivot shafts 24 will end up ahead of the shield, only a minor portion of the cylinders projecting behind the collar 18 of the shield.

What I claim is:

1. Boat propeller drive unit comprising a portion intended to be fixed in an opening on a boat transom stern for connection to an engine accommodated on the inside of the transom stern and to a propeller drive shaft housing disposed outside the transom stern and carried by a fork-like support structure having shanks journalled in the fixed portion for rotation about a transverse horizontal pivot axis under the influence of a pair of pressurized-medium actuated piston-cylinder units disposed on either side of the centerplane of a drive shaft of the engine, coacting locking members being arranged for preventing in their locking position the support structure from swinging about said pivot axis, characterized in that one end of each piston-cylinder unit is pivotally connected to the fixed portion, whereas the other end rests on an abutment surface on the fork-like support structure; and in that a first of the locking members is disposed on an intermediate member pivotally connected to the piston-cylinder units and to the support structure in such a way that the position of said locking member relative to a second locking member, carried by the support structure, with which said first locking member coacts, remains unchanged upon alteration of the angle of the support structure relative to the fixed portion.

2. Boat propeller drive unit as claimed in claim 1, wherein the intermediate member comprises two transversely mutually spaced parts, bearings for said spaced parts disposed in the support structure inside of the support shanks and spaced away from the pivot axis of the shanks; and wherein one of the locking members is formed of a pivot pin extending between both parts of the intermediate member.

3. Boat propeller drive unit as claimed in claim 2, wherein each part of the intermediate member comprises a pair of mutually spaced and transversely arranged metal sheets or plates fixed to each other, between which the respective piston-cylinder unit projects while gripping around a pivot pin connected to said plates.

4. Boat propeller drive unit as claimed in claim 3, wherein the two parts of the intermediate member are essentially triangular with the bearings in the support structure disposed at the upper corner, the pin connected to the piston-cylinder unit at the rear base corner, and a reinforcement rod extending between said parts at the front base corner, the pin, consituting the locking member, being disposed in the area between the base corners.

5. Boat propeller drive unit as claimed in claim 2, wherein the end of the support structure facing away from the bearings has a forwardly directed recess and in that the abutment surfaces for the respective piston-cylinder unit are disposed within said recess.

6. Boat propeller drive unit as claimed in claim 5, wherein the two parts of the intermediate member are essentially triangular with the bearings in the support structure disposed at the upper corner, the pin connected to the piston-cylinder unit at the rear base corner, and a reinforcement rod extending between said parts at the front base corner, the pin, constituting the locking member, being disposed in the area between the base corners.

7. Boat propeller drive unit as claimed in claim 1, wherein the fixed portion has a rearwardly directed collar inside of which the piston-cylinder units are accommodated.

8. Boat propeller drive unit as claimed in claim 7, wherein the fixed portion has a bottom portion, which when mounted projects into the opening made in the transom stern of the boat; and in that the piston-cylinder units are journalled on pivot pins in the bottom portion.

* * * * *